US009723961B1

(12) United States Patent
Tran et al.

(10) Patent No.: US 9,723,961 B1
(45) Date of Patent: Aug. 8, 2017

(54) VACUUM CLEANER

(71) Applicant: BISSELL Homecare, Inc., Grand Rapids, MI (US)

(72) Inventors: Phong Hoang Tran, Grand Rapids, MI (US); Thomas Wiedmaier, Pagosa Springs, CO (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 795 days.

(21) Appl. No.: 14/156,644

(22) Filed: Jan. 16, 2014

Related U.S. Application Data

(60) Provisional application No. 61/754,238, filed on Jan. 18, 2013.

(51) Int. Cl.
*A47L 9/04* (2006.01)
*A47L 5/30* (2006.01)

(52) U.S. Cl.
CPC ..... *A47L 9/0444* (2013.01); *A47L 9/0477* (2013.01); *A47L 5/30* (2013.01)

(58) Field of Classification Search
CPC .. A47L 5/30; A47L 11/24; A47L 11/28; A47L 9/0444; A47L 9/0447
USPC ..... 15/351, 389, 410
See application file for complete search history.

(56) References Cited

U.S. PATENT DOCUMENTS 4,446,594 A 5/1984 Watanabe et al.
4,446,595 A 5/1984 Nakada et al.
4,581,787 A 4/1986 Torigoe et al.
4,748,714 A * 6/1988 Tschudy ..... A47L 5/30 15/332
5,768,746 A 6/1998 Kamatani et al.
5,839,160 A 11/1998 Wang et al.
5,974,622 A * 11/1999 Louis ..... A47L 5/30 15/340.2
6,044,520 A * 4/2000 Yamamoto ..... A47L 5/30 15/351
6,209,168 B1 * 4/2001 Brickner ..... A47L 5/30 15/332
7,475,450 B1 * 1/2009 Ragner ..... A47L 5/30 15/384
7,653,964 B2 * 2/2010 Kwon ..... A47L 5/34 15/354
7,694,385 B2 * 4/2010 Choi ..... A47L 5/30 15/389
2004/0078924 A1 * 4/2004 Roney ..... A47L 5/30 15/384
2004/0117942 A1 * 6/2004 Roney ..... A47L 5/30 15/390

(Continued)

FOREIGN PATENT DOCUMENTS

JP 6154134 A 6/1994
JP 2006081783 A 3/2006

*Primary Examiner* — Michael Jennings
(74) *Attorney, Agent, or Firm* — McGarry Bair PC

(57) ABSTRACT

A vacuum cleaner has an agitator assembly, a belt drive system coupling the agitator assembly to a motor via a belt, and a belt shifting assembly which selectively shifts the belt between a drive pulley and an idler pulley on the agitator assembly. Trace rotational force transmitted to the agitator assembly when the belt is on the idler pulley is prevented from causing the agitator assembly to rotate by an anti-rotation member of the belt shifting assembly.

19 Claims, 8 Drawing Sheets

(56) References Cited

U.S. PATENT DOCUMENTS

| | | | | |
|---|---|---|---|---|
| 2005/0210625 | A1* | 9/2005 | Joung | A47L 9/0444 15/390 |
| 2005/0217069 | A1* | 10/2005 | Joung | A47L 5/30 15/390 |
| 2008/0271285 | A1* | 11/2008 | Maurer | A47L 5/30 15/389 |
| 2010/0017999 | A1* | 1/2010 | Bassett | A47L 5/30 15/389 |
| 2013/0055526 | A1* | 3/2013 | Tran | A47L 5/12 15/383 |

* cited by examiner

VACUUM CLEANER

CROSS-REFERENCE TO RELATED APPLICATION(S)

This application claims the benefit of U.S. Provisional Patent Application No. 61/754,238, filed Jan. 18, 2013, which is incorporated herein by reference in its entirety.

BACKGROUND

Vacuum cleaners typically employ an agitator assembly that is configured to release dust, hair and other debris, collectively referred to herein as debris, from a surface to be cleaned. The debris is transported via a working airflow to a downstream separator that separates the debris from the working airflow and deposits the debris in a downstream dirt collector.

A vacuum cleaner agitator assembly typically comprises an agitator dowel that is rotatably mounted within a housing and configured to rotate about bearing assemblies at each end thereof. An agitator assembly can be driven by a belt operably connecting a shaft on a motor to a drive pulley on the agitator dowel. Optionally, the agitator assembly can include clutch mechanism for selectively engaging or disengaging the agitator drive. One type of clutch mechanism is a belt shifter that can selectively shift the belt onto an idler pulley on the agitator dowel to selectively stop rotation of the agitator assembly, while continuing rotation of the motor shaft.

BRIEF SUMMARY

A vacuum cleaner comprises a housing comprising an agitator cavity and a suction nozzle, an agitator assembly mounted in the agitator cavity for rotation about an axis, the agitator assembly further comprising an idler pulley and a drive pulley, a motor, a belt coupling the motor to the agitator assembly, and a belt shifting assembly selectively coupling and uncoupling the agitator assembly in a driving relationship with the motor. The belt shifting assembly comprises a belt shifter movable between an idle position where the belt is engaged with the idler pulley and a drive position where the belt is engaged with the drive pulley to selectively rotate the agitator assembly, and an anti-rotation member operably coupled with the belt shifter, wherein the anti-rotation member is in contact with the agitator assembly when the belt shifter is in the idle position and is out of contact with the agitator assembly when the belt shifter is in the drive position.

DETAILED DESCRIPTION

The invention relates to vacuum cleaners, and in particular to vacuum cleaners having a single motor/fan assembly configured to generate a working air flow through the cleaner and to drive an agitator assembly. In one of its aspects, the invention relates to a belt shifter mechanism for selectively driving the agitator assembly and for selectively uncoupling the agitator assembly from a driving relationship with the motor/fan assembly. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary.

Figure 1:
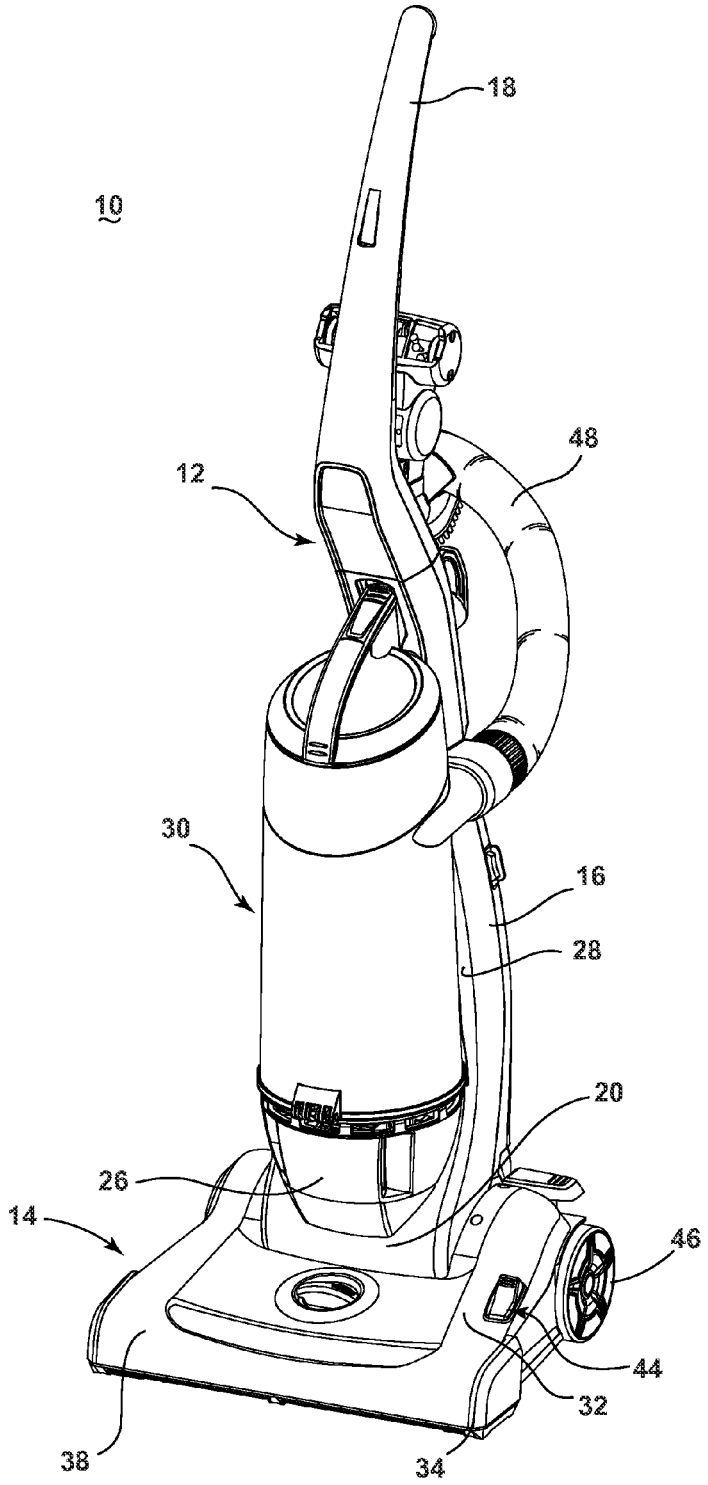
FIG. 1 is a perspective view of a vacuum cleaner according to one embodiment of the invention.
Figure 2:
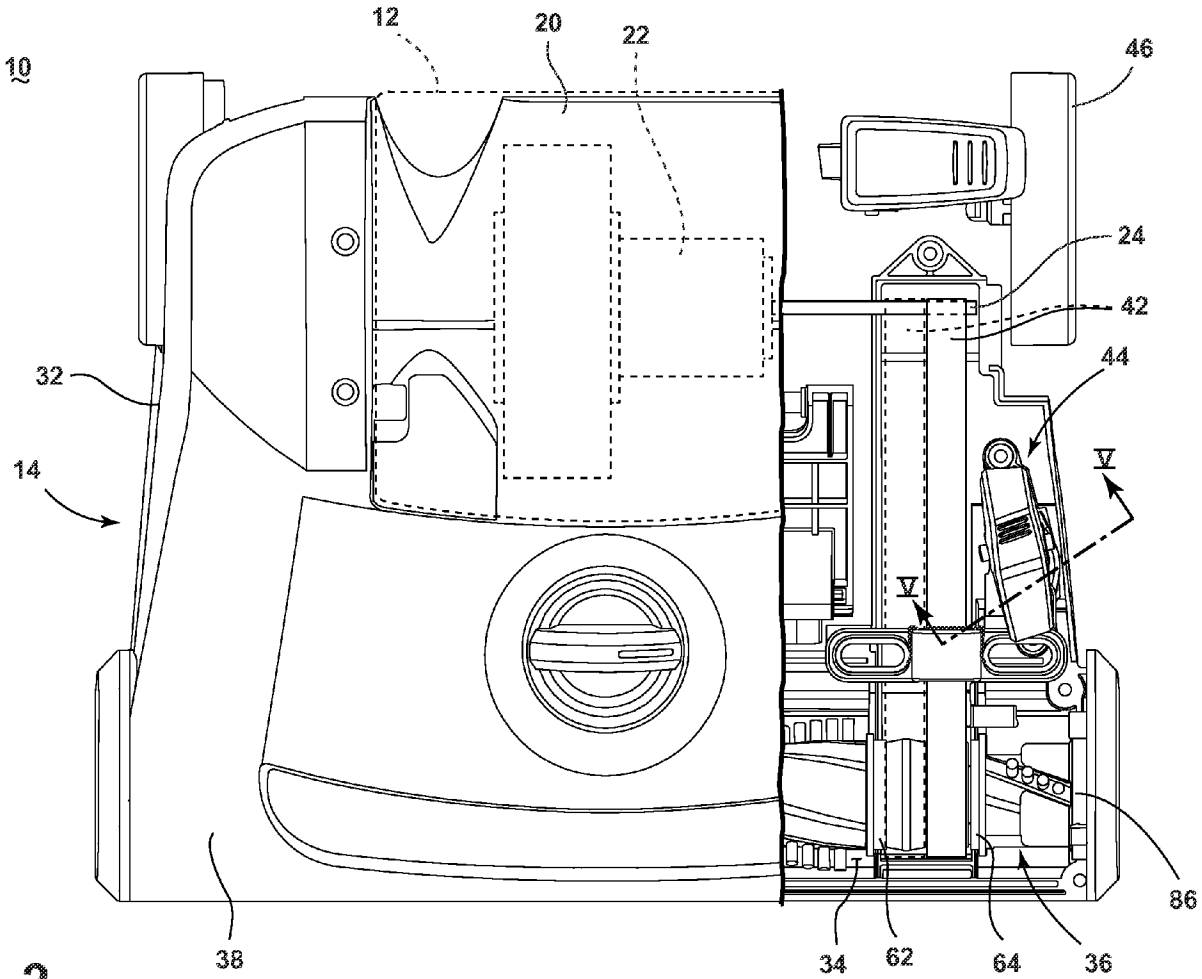
FIG. 2 is a top view of a base of the vacuum cleaner from FIG. 1, with a portion of the vacuum cleaner cut away to show an agitator assembly, associated drive system and a belt shifting assembly.

Referring to the drawings, and in particular to FIGS. 1-2, an upright vacuum cleaner 10 according to a first embodiment of the invention comprises an upright handle assembly 12 pivotally mounted to a foot assembly 14. The handle assembly 12 further comprises a primary support section 16 with a grip 18 on one end to facilitate movement by a user. A motor cavity 20 is formed at an opposite end of the handle assembly 12 and contains a conventional suction source such as a vacuum fan/motor assembly 22 (FIG. 2) oriented transversely therein. The handle assembly 12 pivots relative to the foot assembly 14 through a pivot axis that is coaxial with a motor shaft 24 associated with the vacuum fan/motor assembly 22. A post-motor filter housing 26 is formed above the motor cavity 20 and is in fluid communication with the vacuum fan/motor assembly 22, and receives a filter media (not shown) for filtering air exhausted from the vacuum fan/motor assembly 22 before the air exits the vacuum cleaner 10. A mounting section 28 on the primary support section 16 of the handle assembly 12 receives a separation/collection module 30 for separating and collecting dirt and other contaminants from a dirt-containing working airstream for later disposal.

The foot assembly 14 comprises a housing 32 with a suction nozzle 34 formed at a lower surface thereof and that is in fluid communication with the vacuum fan/motor assembly 22. When the separation/collection module 30 is received in the mounting section 28, as shown in FIG. 1, the separation/collection module 30 is in fluid communication with, and fluidly positioned between, the suction nozzle 34 and the vacuum fan/motor assembly 22 within the motor cavity 20. At least a portion of the working air pathway between the suction nozzle 34 and the separation/collection module 30 can be formed by a vacuum hose 48 that can be selectively disconnected from fluid communication with the suction nozzle 34 for above-the-floor cleaning.

FIG. 2 is a top view of the vacuum cleaner 10 according to an embodiment of the invention, which shows a lower portion of the handle assembly 12 and the foot assembly 14, with a portion of the housing 32 cut away. An agitator assembly 36 is positioned within an agitator chamber 38 formed at a forward portion of the housing 32, and is in fluid communication with the suction nozzle 34. The agitator assembly 36 substantially spans the suction nozzle 34. The agitator assembly 36 is operably connected to the vacuum fan/motor assembly 22, which is oriented transversely within the motor cavity 20 and comprises a fan and a motor with a motor shaft 24 which is oriented substantially parallel to the surface to be cleaned and protrudes from the motor cavity 20 into a rear portion of the housing 32. The fan is driven by the motor to generate a working air flow at the suction nozzle 34. A stretch belt 42 operably connects the motor shaft 24 to the agitator assembly 36 for transmitting rotational motion of the motor shaft 24 to the agitator assembly 36. Alternatively, a separate, dedicated agitator drive motor (not shown) can be provided to drive the agitator assembly 36.

An agitator drive clutch mechanism 44 is provided to the foot assembly 14 so that the user can manually engage and disengage an agitator drive system to selectively drive or not drive the agitator assembly 36, while still operating the fan/motor assembly 22. Furthermore, rear wheels 46 are secured to a rearward portion of the foot assembly 14 and front wheels (not shown) are secured to a forward portion of the foot assembly 14 for moving the foot assembly 14 over a surface to be cleaned.

Figure 3:
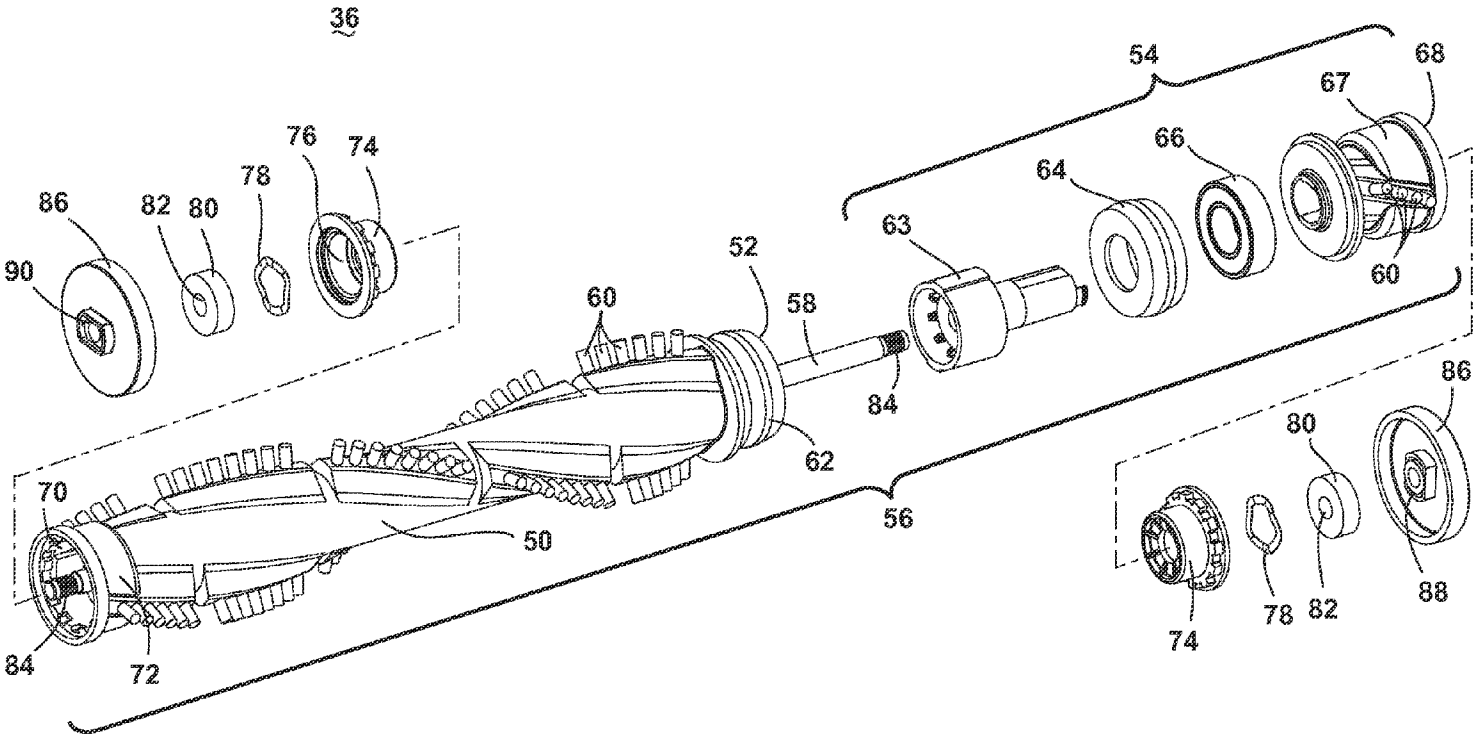
FIG. 3 is an exploded view of the agitator assembly of FIG. 2.

FIG. 3 is a partially exploded view of the agitator assembly 36, which comprises a rotatable brushroll having a brush dowel 50 with a recessed end 52 that is configured to receive a dowel insert 54 therein. The brush dowel 50 and dowel insert 54 can be fixed together to form a dowel assembly 56 that is rotatably mounted about an agitator shaft 58 that lies along the longitudinal axis of the agitator assembly 36. A plurality of bristle tufts 60 protrude from the outer periphery of dowel assembly 56, for example, from both the brush dowel 50 and the dowel insert 54. A drive pulley 62 is formed near the recessed end 52 of the brush dowel 50. The dowel insert 54 further comprises a sleeve 63 with one end that is stepped-down to a reduced diameter to receive an idler pulley 64 and corresponding idler bearing 66 thereon. The stepped-down portion also receives a dowel extension 67 with bristle tufts 60 protruding therefrom. The dowel insert 54 can be fastened to the brush dowel 50 by a variety of known manufacturing processes, including adhesive, welding, press-fit or mechanical fasteners, for example. When the dowel insert 54 is fixed to the brush dowel 50, the idler pulley 64 is positioned adjacent to the fixed drive pulley 62 and can rotate freely relative to the dowel insert 54 and dowel 50, about the idler bearing 66.

The shaft 58 extends through the center of the dowel assembly 56 along the longitudinal axis of the agitator assembly 36. A first cavity 68 is provided in the outboard end of the dowel insert 54 and a second cavity 70 is provided in a second end 72 of the dowel 50, opposite the recessed end 52. Each cavity 68, 70 receives a substantially identical bearing assembly which includes a bearing holder 74 mounted within the cavity 68, 70. The bearing holder 74 includes a pocket 76 for receiving a wavy spring washer 78 and bearing 80 therein. The bearing 80 includes a central aperture 82, which is configured to be press fit onto the shaft 58, inboard from a stepped, knurled end 84 of the shaft 58.

An end cap 86 comprises an internal collar 88 that can be press fit onto the knurled end 84 of the shaft 58. An outer projection 90 is received in a corresponding retention feature (not shown) within the housing 32. The outer projection 90 can be keyed to the corresponding retention feature to prevent rotation of the end caps 86 relative to the agitator chamber 38.

Figure 4:
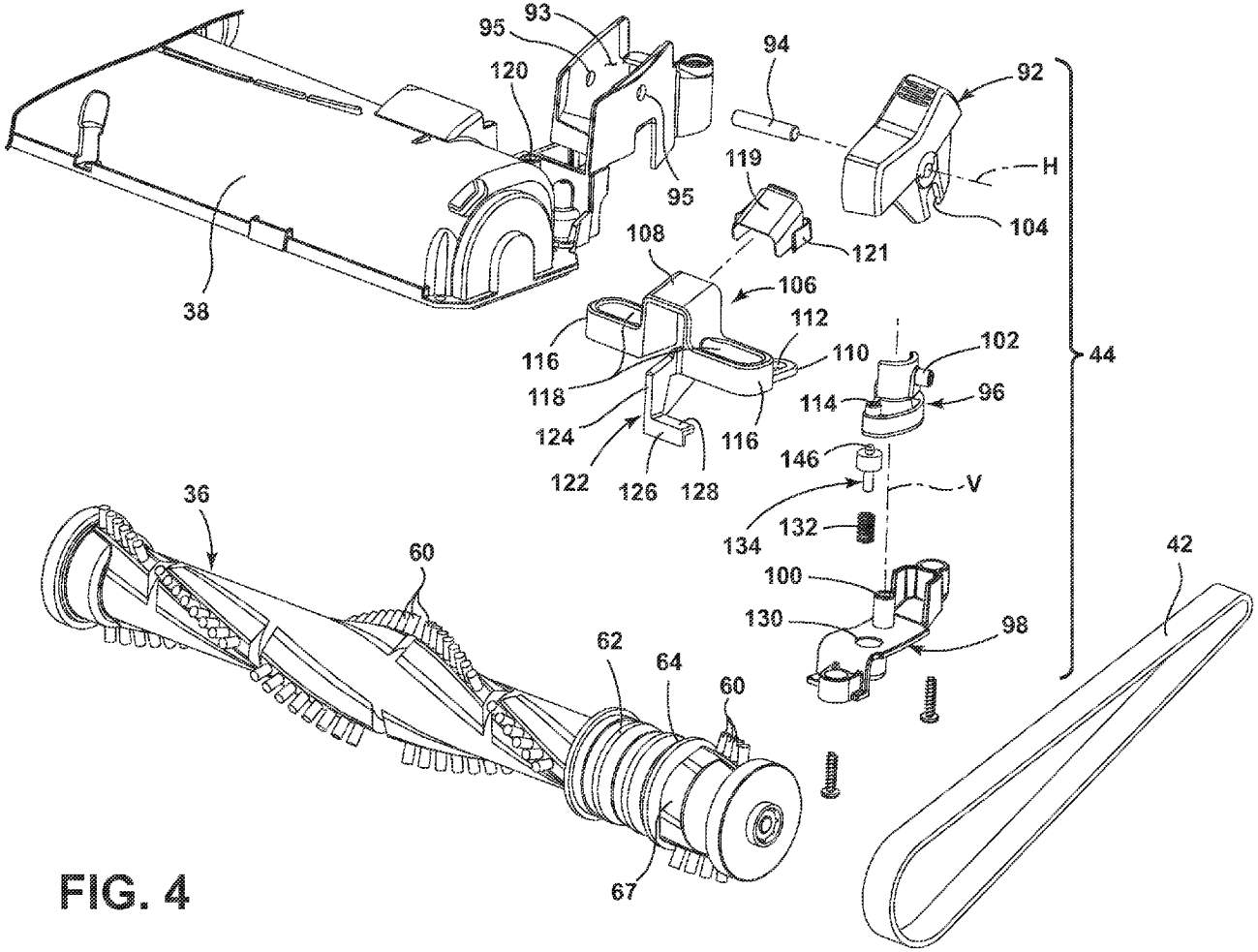
FIG. 4 is a partially-exploded view of the agitator housing, agitator assembly and belt shifting assembly from FIG. 2.

FIG. 4 is a partially-exploded view of the agitator assembly 36, the agitator drive clutch mechanism 44 and agitator chamber 38. The agitator drive clutch mechanism 44 is shown herein as a belt shifting assembly 44, which can manually engage and disengage the agitator drive system to selectively drive or not drive the agitator assembly 36 by shifting the belt 42 between the drive pulley 62 and the idler pulley 64, and vice versa, while still operating the fan/motor assembly 22

The belt shifting assembly 44 comprises a pedal 92, a linkage member 96 operably connected to the pedal 92, a bracket 98 which pivotally mounts the linkage member 96 to the agitator chamber 38, and a belt shifter 106 which is operably connected to the linkage member 96 and which engages the belt 42 to shift the belt 42 between the drive pulley 62 and the idler pulley 64 of the agitator assembly 36.

The pedal 92 is pivotally mounted to the agitator chamber 38 along a horizontal axis "H" defined by a pivot shaft 94. The pedal 92 is seated in a pedal receiver 93, shown herein as integrally formed with the agitator chamber 38, but which could also be provided elsewhere on the foot, with the pivot shaft 94 received in pivot openings 95 in the pedal receiver 93. An arm 102 on the linkage member 96 slidably engages an arm receiver 104 on the pedal 92, which is defined by a slotted rib on the lower portion of the pedal 92. The linkage member 96 is configured to pivot about a vertical axis "V" defined by a pivot boss 100 on the bracket 98 when the pedal is moved about the horizontal axis "H".

The belt shifter or belt yoke 106 comprises a yoke in the form of a U-shaped belt-engaging portion 108 that partially surrounds the edges of the belt 42 and a bushing arm 110 with a slotted hole 112 therein that receives a linkage pin 114 on a lower portion of the linkage member 96. The belt yoke 106 further comprises guide arms 116 extending outwardly from both sides of the belt-engaging portion 108. An elongate opening in each guide arm 116 defines a guide slot 118 that is configured to be slidably mounted onto a corresponding guide post 120 (only one of which is visible in FIG. 4) on the agitator chamber 38. Each guide slot 118 can be slidably retained to the corresponding guide post 120 by washer head screws (not shown), so that the belt yoke 106 can slide laterally on the guide posts 120.

A wear guard 119 can be provided on the belt yoke 106 to protect the belt yoke 106 against wear caused by contact with the moving belt 42. The wear guard 119 comprises a formed strip that nests within the U-shaped belt-engaging portion 108 and prevents damage of the belt yoke 106 caused by the edge of the belt 42 rubbing against the U-shaped belt-engaging portion 108 during operation. The wear guard 119 is retained to the belt yoke 106 by a plurality of clips 121 on the edges of the formed strip that are configured to clamp against the outer walls of the belt-engaging portion 108. The wear guard 119 can comprise a material that is resistant to abrasion by the belt 42. In one example, the wear guard 109 comprises a sheet metal strip, such as steel or aluminum.

The belt shifting assembly 44 further comprises an anti-rotation member 122 that is configured to be in contact with the agitator assembly 36 when the belt shifting assembly 44 is in an idle position and is out of contact with the agitator assembly 36 when the belt shifting assembly 44 is in a drive position, as explained in further detail below. As illustrated, the anti-rotation member can comprise a brake arm 122 on the belt yoke 106 that is configured to selectively rub against the tips of the bristle tufts 60 to stop rotation of the dowel assembly 56 when the belt yoke 106 shifts the belt 42 from the drive pulley 62 onto the idler pulley 64. The brake arm 122 extends downwardly from the belt-engaging portion 108 and comprises an L-shaped member with a vertical support wall 124 and a contact arm 126 that extends outwardly therefrom. The contact arm 126 can further comprise a stiffening rib 128 that is configured to limit the deflection of the contact arm 126 during use. The contact arm 126 is configured to selectively interfere with the tips of the bristles tufts 60 on the dowel extension 67 to brake the agitator assembly 36 when the belt 42 is shifted from the drive pulley 62 onto the idler pulley 64.

Optionally, the contact arm 126 can further comprise a wear guard (not shown) to shield the contact arm 126 from abrasion by the bristle tufts 60. In one example the wear guard can comprise a sleeve formed of a material that is resistant to abrasion by the bristle tufts 60, such as a sheet metal, for example.

A biasing member can be operably coupled to the belt yoke 106 to bias the belt yoke 106 between the idle position and the drive position such that the belt 42 will not get stuck in an intermediate position between the drive and idler pulleys 62, 64 (FIG. 4), as explained in further detail below. As shown, the biasing member can comprise a spring-loaded detent pin 134 which urges the belt yoke 106 to move the belt 42 fully onto the drive pulley 62 or the idler pulley 64. The detent pin 134 can move relative to a cam provided on the linkage member 96 or elsewhere on the belt shifting assembly 44. For example, the cam could be provided directly on the belt yoke 106.

Figure 5:
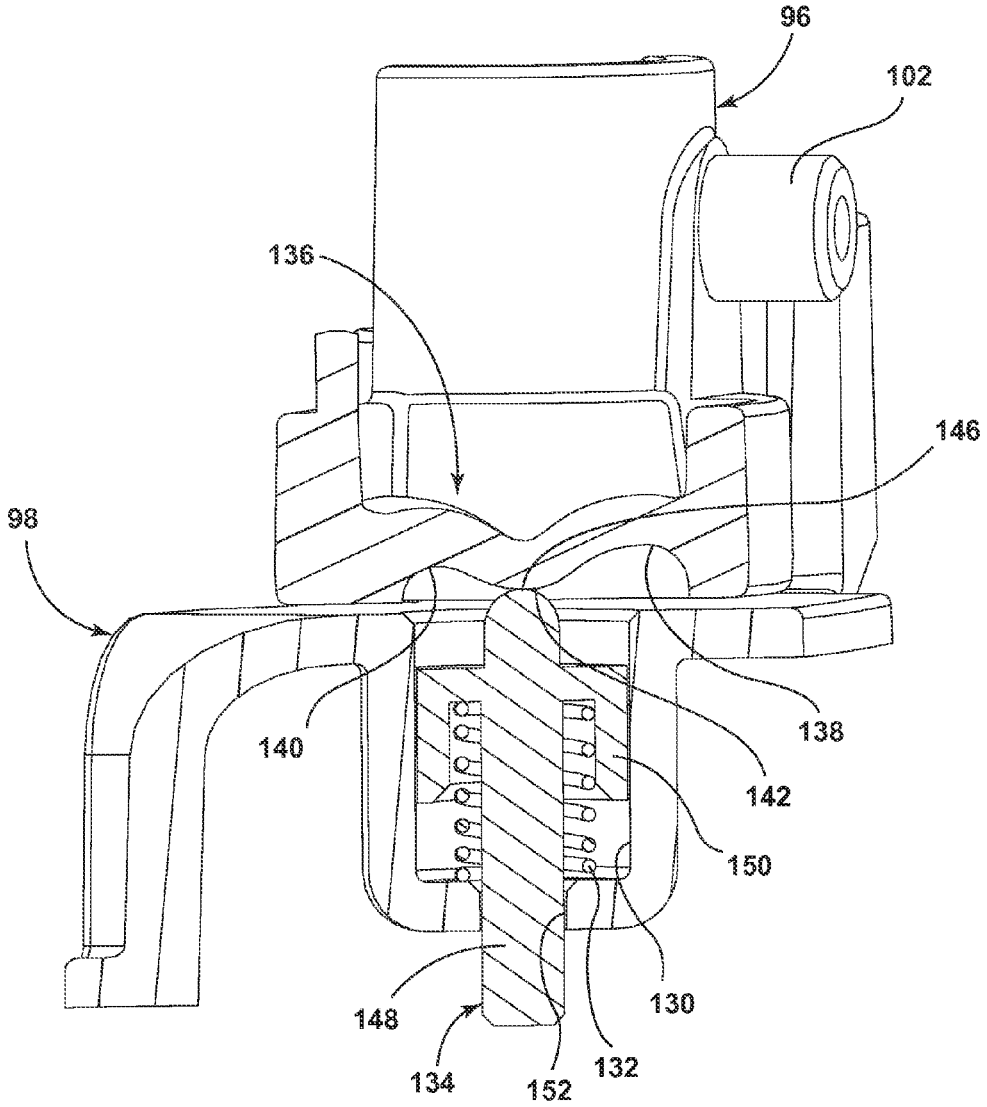
FIG. 5 is a cross-sectional view of a portion of the belt shifting assembly taken along line V-V of FIG. 2.

FIG. 5 is a cross-sectional view taken along line V-V of FIG. 2 showing the linkage member 96 and the bracket 98 of the belt shifting assembly 44. The bracket 98 comprises a pocket 130 that receives a coil spring 132 and the detent pin 134 therein. The detent pin 134 includes a pin shaft 148, a larger pin head 150 connected to the upper portion of the pin shaft 148, and a protruding upper tip 146 on the pin head 148. The pocket 134 includes an opening 152 in the bottom surface thereof which slidingly receives the pin shaft 148. The coil spring 132 biases the pin head 150 outwardly from the pocket 130 to register with a cam on the linkage member 96. The cam as shown herein includes a detent track 136 formed on the bottom surface of the linkage member 96, which has a recessed cammed surface with spaced first and second detents 138, 140 separated by a cam lobe 142. The cam lobe 142 is inclined upwardly from the middle of the detent track 136 toward the first and second detents 138, 140.

The spring-biased detent pin 134 engages the detent track 136, with the coil spring 132 pushing the pin head 150 upwardly into the detent track 136. The first and second detents 138, 140 are configured to seat the upper tip 146 of the detent pin 134, which can be rounded to enable smooth sliding along the detent track 136. The detent pin 134, under pressure from the coil spring 132, slides along either side of the cam lobe 142 and urges the linkage member 96 to rotate until the upper tip 146 seats into the adjacent first or second detent 138, 140. Thus, the detent pin 134 snaps into either of the first or second detents 138, 140 and the upward force applied by the detent pin 134 onto the cam lobe 142 urges the linkage member 96 to rotate fully.

FIGS. 6-11 illustrate the operation of the belt shifting assembly 44. When the linkage member 96 is pivoted about the vertical axis "V", movement is translated to the belt yoke 106 via the linkage pin 114 and bushing arm 110 so that the guide arms 116 slide on the guide posts 120 between an inner drive position most clearly shown in FIGS. 6-7, in which the belt 42 is shifted onto the drive pulley 62 and an outer idle or non-drive position shown in FIGS. 9-10, in which the belt 42 is shifted onto the idler pulley 64. Specifically, the belt-engaging portion 108, including the wear guard 119 nested therein, contacts either outer edge of the belt 42 and translates the belt 42 laterally along the motor shaft 24, which shifts the opposite end of the belt 42 between the drive pulley 62 and the idler pulley 64, depending on whether a user desires to operate the vacuum cleaner 10 with or without rotation of the agitator assembly 36.

Figure 6:
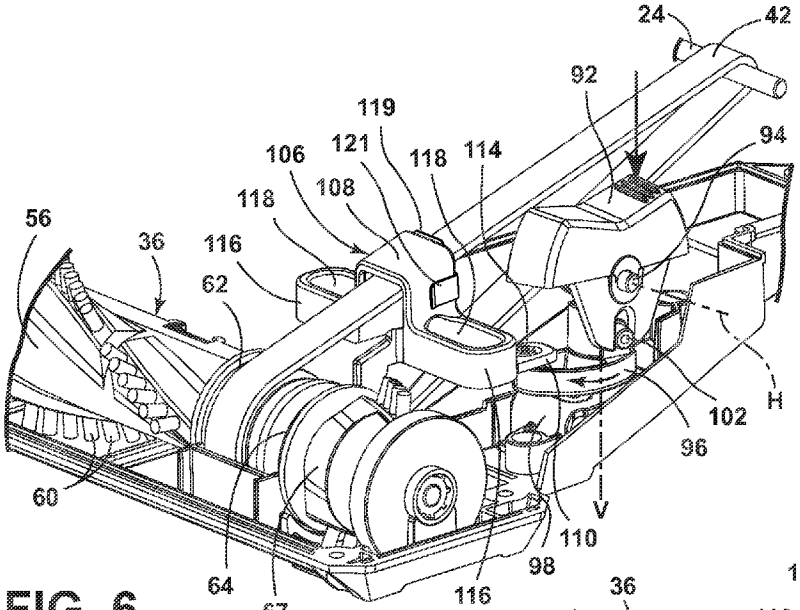
FIGS. 6-8 are a perspective view, a top view, and a sectional view similar to FIG. 5, respectively, of the belt shifting assembly, illustrating the operation of the belt shifting assembly to transmit rotation to the agitator assembly.
Figure 7:
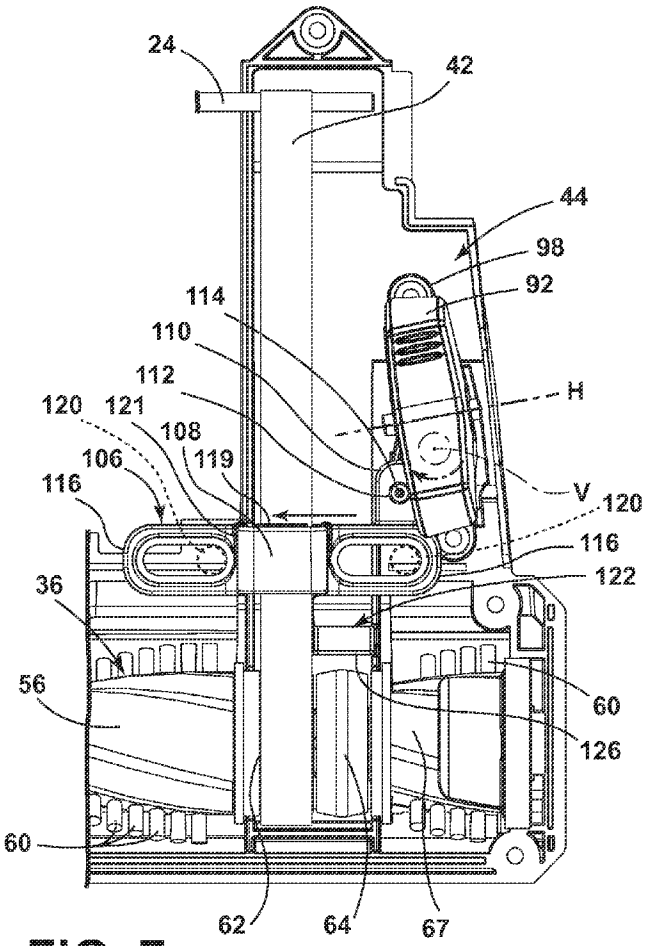
Figure 8:
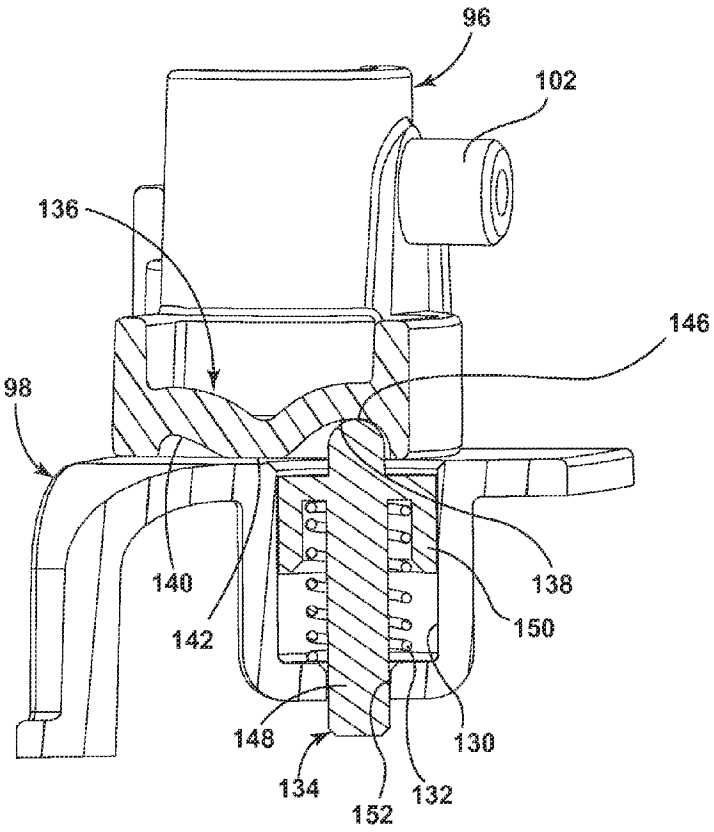

Referring to FIGS. 6-8, to shift the belt 42 from the idler pulley 64 to the drive pulley 62 the pedal 92 is pivoted rearwardly about the horizontal axis "H" by depressing a rear end of the pedal 92 as shown in FIG. 6, and the pedal 92 forces the arm 102 of the linkage member 96 forwardly, which, in turn, pivots the linkage member 96 inwardly about the vertical axis "V." As the linkage member 96 pivots, the linkage pin 114 arcs inwardly and pushes the bushing arm 110 to slide the belt yoke 106 inwardly on the bearing surface formed between the guide slots 118 and guide posts 120 to the drive position shown in FIGS. 6-7. The belt-engaging portion 108 of the belt yoke 106, including the wear guard 119 nested therein, shifts the belt 42 onto the drive pulley 62, and rotational force can be transmitted from the motor shaft 24 to the dowel assembly 56 of the agitator assembly 36 via the belt 42 and drive pulley 62.

Also as the pedal 92 pivots the linkage member 96 to the drive position corresponding to the drive position of the belt yoke 106 shown in FIGS. 6-7, as shown in FIG. 8, the spring-biased detent pin 134 mounted in the bracket 98 beneath the linkage member 96 slides within the detent track 136. In the drive position, the upper tip 146 of the detent pin 134 is seated in the first detent 138 as shown in FIG. 8. However, if the rear end of the pedal 92 is not fully depressed, the spring-biased detent pin 134 can urge the linkage member 96 to rotate fully to the drive position by bearing against the cam lobe 142. The coil spring 132 biases the upper tip 146 against the cam lobe 142 of the detent track 136 with sufficient force to induce complete rotation of the linkage member 96 to the drive position so that the upper tip 146 becomes fully seated within the outboard first detent 138. So, the coil spring 132 exerts enough force on the detent pin 134 to force the linkage member 96 to rotate fully to the drive position even if the pedal 92 is only partially depressed. Thus, the belt shifting assembly 44 is configured to completely shift the belt 42 onto the drive pulley 62 so that the belt yoke 106 will not stick in an intermediate position partially spanning the drive pulley 62 and idler pulley 64, even if the pedal 92 is only partially depressed.

Moreover, when the linkage member 96 is in the drive position, the coil spring 132 biases the upper tip 146 of the detent pin 134 into the first detent 138, which selectively retains the linkage member 96 in the drive position and avoids inadvertent shifting of the belt 42. When the upper tip 146 is seated within the first detent 138, the linkage member 96 cannot rotate out of the drive position unless the linkage member 96 is rotated with sufficient force for the cam lobe 142 to bear against the upper tip 146, compress the coil spring 132, and urge the upper tip 146 to slide out of the first detent 138. Thus, the belt shifting assembly 44 is configured to retain the belt 42 on the drive pulley 62 when the upper tip 146 is seated in the first detent 138 and will not inadvertently shift the belt 42 onto the idler pulley 64 until the pedal 92 is depressed and the upper tip 146 is forced to slide out of the first detent 138.

Figure 9:
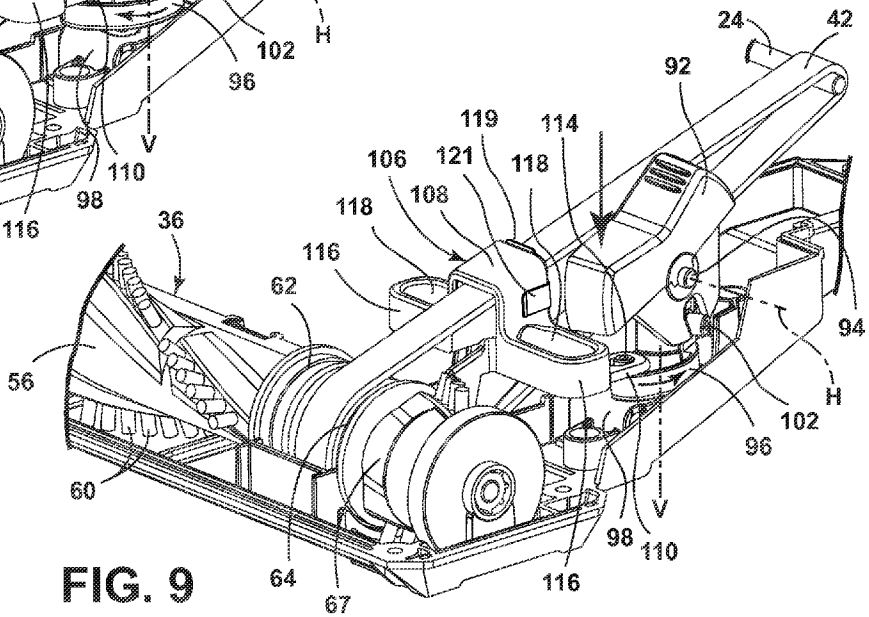
FIGS. 9-11 are a perspective view, a top view, and a sectional view similar to FIG. 5, respectively, of the belt shifting assembly, illustrating the operation of the belt shifting assembly to stop rotation of the agitator assembly.
Figure 10:
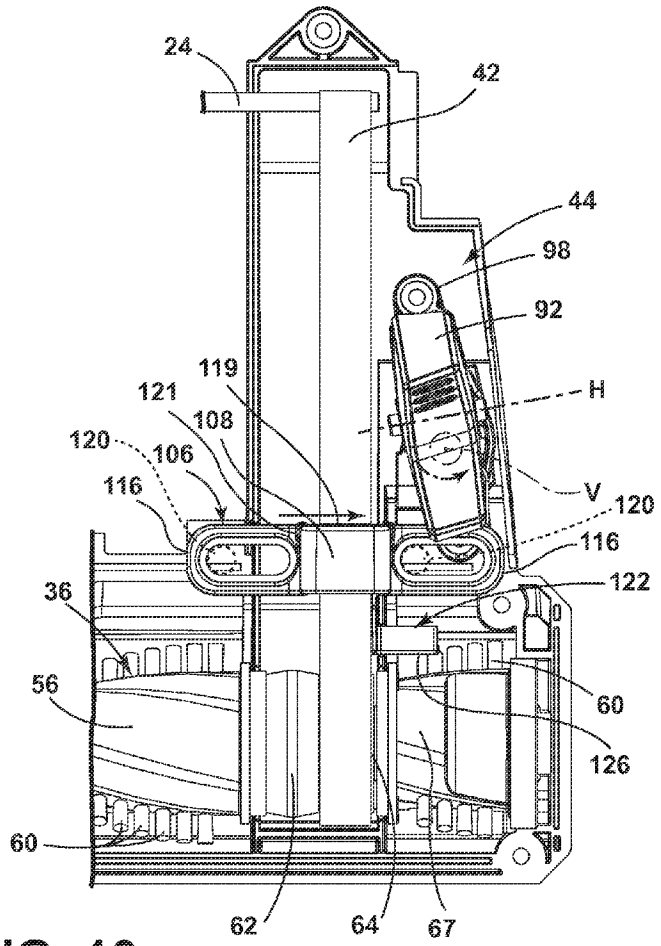
Figure 11:
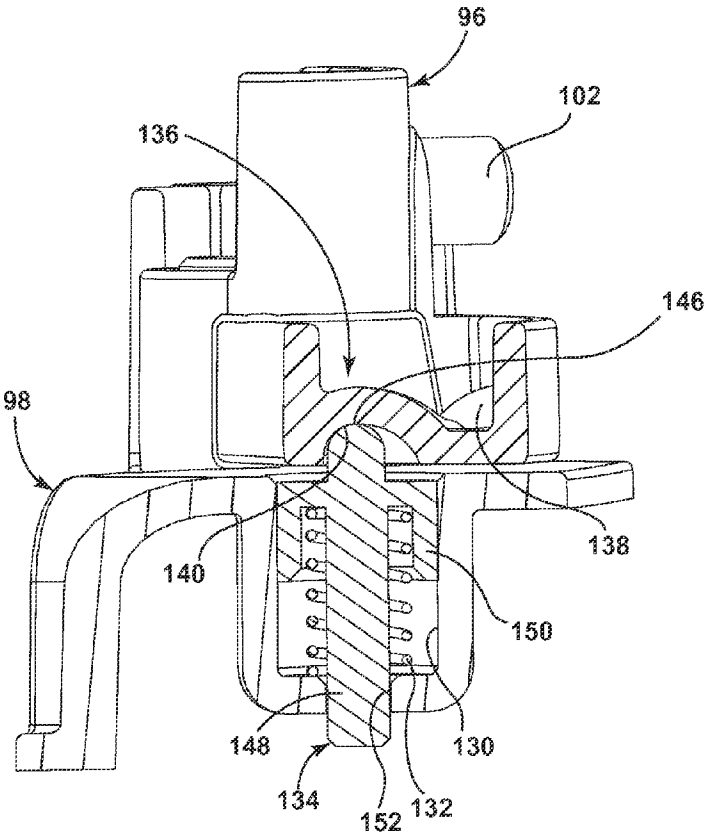

Referring to FIG. 9-11, to shift the belt 42 from the drive pulley 62 to the idler pulley 64, the pedal 92 is pivoted forwardly about the horizontal axis "H" by depressing a front end of the pedal 92 as shown in FIG. 9, and the pedal 92 forces the arm 102 of the linkage member 96 rearwardly, which, in turn, pivots the linkage member 96 outwardly about the vertical axis "V." As the linkage member 96 pivots, the linkage pin 114 arcs outwardly and pulls the bushing arm 110 to slide the belt yoke 106 outwardly on the bearing surface formed between the guide slots 118 and guide posts 120 to the non-drive position shown in FIGS. 9-10. The belt-engaging portion 108 of the belt yoke 106 shifts the belt 42 onto the idler pulley 64. In this orientation, rotational force can be transmitted from the motor shaft 24 to the idler pulley 64 via the belt 42, but no rotational force is transmitted to the dowel assembly 56 of the agitator assembly 36.

Also as the pedal 92 pivots the linkage member 96 to the non-drive position corresponding to the non-drive position of the belt yoke 106 shown in FIGS. 9-10, as shown in FIG. 11, the spring-biased detent pin 134 mounted in the bracket 98 beneath the linkage member 96 slides within the detent track 136. In the non-drive position, the upper tip 146 of the detent pin 134 is seated in the second detent 140 as shown in FIG. 11. However, if the front end of the pedal 92 is not fully depressed, the spring biased detent pin 134 can urge the linkage member 96 to rotate fully to the non-drive position by bearing against the cam lobe 142. The coil spring 132 biases the upper tip 146 to slide along the cam lobe 142 of the detent track 136 with sufficient force to induce complete rotation of the linkage member 96 to the non-drive position so that the upper tip 146 becomes fully seated within the second detent 140. So, the coil spring 132 exerts enough force on the detent pin 134 to force the linkage 96 to rotate fully to the non-drive position even if the pedal 92 is only partially depressed. Thus, the belt shifting assembly 44 is configured to completely shift the belt 42 onto the idler pulley 64 so that the belt yoke 106 will not stick in an intermediate position partially spanning the idler pulley 64 and drive pulley 62, even if the pedal 92 is only partially depressed.

Moreover, when the linkage member 96 is in the non-drive position, the coil spring 132 biases the upper tip 146 of the detent pin 134 into the second detent 140, which selectively retains the linkage member 96 in the non-drive position and avoids inadvertent shifting of the belt 42. When the upper tip 146 is seated within the second detent 140, the linkage member 96 cannot rotate out of the non-drive position unless the linkage member 96 is rotated with sufficient force for the cam lobe 142 to bear against the upper tip 146, compress the coil spring 132, and urge the upper tip 146 to slide out of the second detent 140. Thus, the belt shifting assembly 44 is configured to retain the belt 42 on the idler pulley 64 when the upper tip 146 is seated within the second detent 140 and will not inadvertently shift the belt 42 onto the idler pulley 64 until the pedal 92 is depressed and the upper tip 146 is forced to slide out of the second detent 140.

When the belt 42 is shifted from the drive pulley 62 onto the idler pulley 64 during operation or when the vacuum cleaner 10 is energized with the belt 42 on the idler pulley 64, friction within the idler bearing 66 (FIG. 3) can cause some undesirable rotational force to be transmitted to the dowel assembly 56. Referring to FIG. 10, when the belt 42 is shifted onto the idler pulley 64 by sliding the belt yoke 106 outwardly to the non-drive position, the brake arm 122 on the belt yoke 106 also slides outwardly until the contact arm 126 interferes with the bristle tufts 60 protruding from the dowel extension 67. The brake arm 122 applies a frictional force onto the ends of the bristle tufts 60 on the dowel extension 67 adjacent to the contact arm 126 to inhibit rotation of the dowel assembly 56. The interference between the contact arm 126 and the bristle tufts 60 overcomes any residual rotational force transmitted to the dowel assembly 56 due to internal friction or momentum between the idler bearing 66 and the dowel assembly 56 as the belt 42 is shifted from the drive pulley 62 to the idler pulley 64. Thus, the brake arm 122 inhibits undesirable rotation of the dowel assembly 56 when the belt 42 is shifted from the drive pulley 62 onto the idler pulley 64.

Conversely, as best shown in FIG. 7, when the belt 42 is shifted onto the drive pulley 62 by sliding the belt yoke 106 inwardly to the drive position, the brake arm 122 on the belt yoke 106 also slides inwardly so that the contact arm 126 slides out of contact with the bristle tufts 60 protruding from the dowel extension 67. The brake arm 122 clears the ends of the bristle tufts 60 on the dowel extension 67 so that the dowel assembly 56 can rotate freely.

While the invention has been specifically described in connection with certain specific embodiments thereof, it is to be understood that this is by way of illustration and not of limitation. For example, while the belt shifting assembly illustrated herein is shown on the foot of an upright vacuum cleaner, it is understood that the invention could be applied to a variety of floor care appliances, including for example, canister vacuum cleaners, upright, canister and portable extraction cleaners, electric sweepers as well as steam mop products having agitation systems. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:

a housing comprising an agitator cavity and a suction nozzle;

an agitator assembly mounted in the agitator cavity for rotation about an axis, the agitator assembly further comprising an idler pulley and a drive pulley;

a motor;

a belt coupling the motor to the agitator assembly; and a belt shifting assembly selectively coupling and uncoupling the agitator assembly in a driving relationship with the motor, comprising:

a belt shifter movable between an idle position where the belt is engaged with the idler pulley and a drive position where the belt is engaged with the drive pulley to selectively rotate the agitator assembly; and an anti-rotation member operably coupled with the belt shifter, wherein the anti-rotation member is in contact with the agitator assembly when the belt shifter is in the idle position and is out of contact with the agitator assembly when the belt shifter is in the drive position.

2. The vacuum cleaner of claim 1 wherein the agitator assembly comprises a brushroll with peripherally-protruding bristles, wherein the anti-rotation member is in contact with the bristles when the belt shifter is in the idle position and is out of contact with the bristles when the belt shifter is in the drive position.

3. The vacuum cleaner of claim 2, wherein the idler pulley and a drive pulley are provided on the brushroll.

4. The vacuum cleaner of claim 1 wherein the anti-rotation member comprises a brake that directly contacts a portion of the agitator assembly to stop rotation of the agitator assembly when the belt shifter is in the idle position.

5. The vacuum cleaner of claim 4, wherein the agitator assembly comprises bristles, and wherein the brake directly contacts the bristles when the belt shifter is in the idle position.

6. The vacuum cleaner of claim 4, wherein the brake comprises an arm extending from the belt shifter.

7. The vacuum cleaner of claim 1 wherein the belt shifting assembly further comprises an actuator and a linkage member operably connecting the actuator to the belt shifter.

8. The vacuum cleaner of claim 7 wherein the actuator comprises a foot pedal.

9. The vacuum cleaner of claim 7 wherein the belt shifting assembly further comprises a bracket pivotally mounting the linkage member to the agitator chamber.

10. The vacuum cleaner of claim 1 wherein the belt shifter comprises a yoke in engagement with the belt.

11. The vacuum cleaner of claim 10, wherein the anti-rotation member comprises a brake arm extending forwardly of the yoke.

12. The vacuum cleaner of claim 10 wherein the yoke comprises a wear guard to protect the yoke against wear caused by contact with the belt.

13. The vacuum cleaner of claim 1 wherein the belt shifting assembly further comprises a biasing member operably coupled to the belt shifter and configured to bias the belt shifter between the idle position and the drive position such that the belt will not get stuck in an intermediate position between the idler and drive pulleys.

14. The vacuum cleaner of claim 13 wherein the biasing member comprises a spring-loaded detent pin configured to urge the belt shifter to one of the idle position and the drive position.

15. The vacuum cleaner of claim 14 wherein the belt shifting assembly further comprises a cam, and wherein the spring-loaded detent pin is in register with the cam.

16. The vacuum cleaner of claim 15, wherein the belt shifting assembly further comprises an actuator and a linkage member operably connecting the actuator to the belt shifter, wherein the cam is provided on the linkage member.

17. The vacuum cleaner of claim 1 wherein the motor comprises a motor shaft and the belt operably connects the motor shaft to the agitator assembly for transmitting rotational motion of the motor shaft to one of the drive pulley or the idler pulley.

18. The vacuum cleaner of claim 1 wherein the motor is further configured to generate a working air flow through the suction nozzle.

19. The vacuum cleaner of claim 18 wherein the housing comprises an upright assembly pivotally mounted to a foot assembly, wherein the motor is located substantially within the upright assembly and the agitator assembly is located within the foot assembly.

* * * * *